US008164052B2

(12) United States Patent
Green et al.

(10) Patent No.: US 8,164,052 B2
(45) Date of Patent: Apr. 24, 2012

(54) MASS SPECTROMETER

(75) Inventors: Martin R. Green, Cheshire (GB); Jason Lee Wildgoose, Stockport (GB); Jeffery Mark Brown, Cheshire (GB)

(73) Assignee: Micromass UK Limited, Manchester (GB)

( * ) Notice: Subject to any disclaimer, the term of this patent is extended or adjusted under 35 U.S.C. 154(b) by 234 days.

(21) Appl. No.: 12/593,006

(22) PCT Filed: Mar. 26, 2008

(86) PCT No.: PCT/GB2008/001028

§ 371 (c)(1), (2), (4) Date: Nov. 17, 2009

(87) PCT Pub. No.: WO2008/117040

PCT Pub. Date: Oct. 2, 2008

(65) Prior Publication Data

US 2010/0072360 A1 Mar. 25, 2010

Related U.S. Application Data

(60) Provisional application No. 60/913,926, filed on Apr. 25, 2007.

(30) Foreign Application Priority Data

Mar. 26, 2007 (GB) ..... 0705730.0

(51) Int. Cl.
*H01J 49/26* (2006.01)
*H01J 49/40* (2006.01)

(52) U.S. Cl. ..... 250/281; 250/282; 250/283; 250/287; 250/288; 250/423 R; 250/424

(58) Field of Classification Search ..... 250/281, 250/282, 283, 287, 288, 423 R, 424
See application file for complete search history.

(56) References Cited

U.S. PATENT DOCUMENTS

| | | | | |
|---|---|---|---|---|
| 7,547,878 | B2 * | 6/2009 | Schultz et al. | 250/282 |
| 2006/0108520 | A1 | 5/2006 | Park | |
| 2010/0301206 | A1 * | 12/2010 | Brown et al. | 250/285 |
| 2011/0024618 | A1 * | 2/2011 | Brown et al. | 250/283 |
| 2011/0062323 | A1 * | 3/2011 | Brown et al. | 250/282 |
| 2011/0114835 | A1 * | 5/2011 | Chen et al. | 250/282 |

FOREIGN PATENT DOCUMENTS

| | | |
|---|---|---|
| DE | 102005004324 | 8/2006 |
| DE | 102005044307 | 3/2007 |
| GB | 2415087 | 12/2005 |
| GB | 2423865 | 6/2006 |

(Continued)

*Primary Examiner* — Nikita Wells
(74) *Attorney, Agent, or Firm* — Diederiks & Whitelaw PLC

(57) ABSTRACT

A mass spectrometer is disclosed comprising an Electron Transfer Dissociation cell (1). Positive analyte ions are fragmented into fragment ions upon colliding with singly charged negative reagent ions with the cell (1). The cell comprises a plurality of ring electrodes (1) which form a spherical trapping volume. Ions experience negligible RF heating over the majority, of the trapping volume which enables the kinetic energy of the analyte and reagent ions to be reduced to just above thermal temperatures. An Electron Transfer Dissociation cell (1) having an enhanced sensitivity is thereby provided. Fragment ions created within the cell (1) may be cooled and may be transmitted onwardly to an orthogonal acceleration Time of Flight mass analyser enabling a significant improvement in the resolution of the mass analyser to be obtained.

14 Claims, 7 Drawing Sheets

FOREIGN PATENT DOCUMENTS

| | | |
|---|---|---|
| GB | 2421843 | 7/2006 |
| GB | 2434911 | 8/2007 |
| GB | 2455187 | 6/2009 |
| WO | 2006042187 | 4/2006 |

* cited by examiner

MASS SPECTROMETER

CROSS REFERENCE TO RELATED APPLICATIONS

This application is the National Stage of International Application No. PCT/GB2008/001028, filed Mar. 26, 2008, which claims priority to and benefit of United Kingdom Patent Application No. 0705730.0, filed Mar. 26, 2007, and U.S. Provisional Patent Application Ser. No. 60/913,926, filed Apr. 25, 2007. The entire contents of these applications are incorporated herein by reference.

The present invention relates to a mass spectrometer. The preferred embodiment relates to an Electron Transfer Dissociation ("ETD") reaction or fragmentation device wherein positively charged analyte ions are fragmented upon reacting or interacting with negatively charge reagent ions. The analyte ions and reagent ions are preferably cooled to near thermal temperatures within a spherical ion trapping volume formed within a modified ion tunnel ion trap. As a result, analyte ions are fragmented with a greater efficiency. The resulting fragment or product ions are also preferably cooled to near thermal temperatures and may then be mass analysed by a Time of Flight mass analyser.

It is known to contain ions having opposite polarities simultaneously within an ion trap. It is also known that the effective potential within an ion trap is independent of the polarity of the ions so that, for example, a quadrupole ion trap may be arranged to store simultaneously both positive and negative ions.

Ion-ion reactions such as Electron Transfer Dissociation ("ETD") and Proton Transfer Reaction ("PTR") have been studied in a modified commercial 3D ion trap. Electron Transfer Dissociation involves causing highly charged positive analyte ions to interact or collide with negatively charged reagent ions. As a result of an ion-ion reaction the positively charged analyte ions are caused to fragment into a plurality of fragment or product ions. The fragment or product ions which are produced enable the parent analyte biomolecule ion to be sequenced.

Electron Capture Dissociation is also known wherein analyte ions are fragmented upon interacting with electrons. However, a particular advantage of Electron Transfer Dissociation reaction or fragmentation as compared with Electron Capture Dissociation is that it is not necessary to provide a relatively strong magnetic field in order to constrain the path of electrons so as to induce ion-electron collisions.

Electron Transfer Dissociation experiments have been attempted in a 3D or Paul ion trap. A 3D or Paul ion trap comprises a central ring electrode and two end-cap electrodes having a hyperbolic surface. Ions are confined within the 3D or Paul ion trap in a quadrupolar electric field in both the axial and radial dimensions. However, although Electron Transfer Dissociation has been investigated using a 3D or Paul ion trap very little if any actual fragmentation of positively charged analyte ions has been observed within such a 3D ion trap.

It is therefore desired to provide an improved Electron Transfer Dissociation reaction or fragmentation device.

According to an aspect of the present invention there is provided an Electron Transfer Dissociation reaction or fragmentation device comprising a plurality of electrodes, wherein the device comprises at least five electrodes each having at least one aperture through which ions are transmitted in use.

Analyte ions and/or reagent ions and/or fragment or product ions created within the device are preferably arranged to assume a mean kinetic energy within the device selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV. The mean kinetic energy of the ions is advantageously arranged to be relatively low.

According to the preferred embodiment a neutrally charged bath gas is preferably provided within the device. Gas molecules of the neutrally charge bath gas are preferably arranged to assume a first mean kinetic energy and analyte ions and/or reagent ions and/or fragment or product ions created within the device are preferably arranged to assume a second mean kinetic energy within the device. The difference between the second mean kinetic energy and the first mean kinetic energy is preferably selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV.

According to an embodiment an Electron Transfer Dissociation reaction or fragmentation device is provided wherein, in use, a neutrally charged bath gas is provided within the device. Gas molecules of the neutrally charged bath gas preferably possess a thermal energy and analyte ions and/or reagent ions and/or fragment or product ions created within the device are preferably arranged to assume a mean kinetic energy within the device, wherein either:

(a) the difference between the mean kinetic energy of the ions and the thermal energy of the bath gas is selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV; and/or (b) the ratio of the mean kinetic energy of the ions to the thermal energy of the bath gas is selected from the group consisting of: (i) <1.05; (ii) 1.05-1.1; (iii) 1.1-1.2; (iv) 1.2-1.3; (v) 1.3-1.4; (vi) 1.4-1.5; (vii) 1.5-1.6; (viii) 1.6-1.7; (ix) 1.7-1.8; (x) 1.8-1.9; (xi) 1.9-2.0; (xii) 2.0-2.5; (xiii) 2.5-3.0; (xiv) 3.0-3.5; (xv) 3.5-4.0; (xvi) 4.0-4.5; (xvii) 4.5-5.0; and (xviii) >5.0.

According to an embodiment the device may comprise 5-10, 10-15, 15-20, 25-30, 30-35, 35-40, 40-45, 45-50, 50-55, 55-60, 60-65, 65-70, 70-75, 75-80, 80-85, 85-90, 90-95, 95-100, 100-110, 110-120, 120-130, 130-140, 140-150, 150-160, 160-170, 170-180, 180-190, 190-200 or >200 electrodes each having at least one aperture through which ions are transmitted in use.

According to an embodiment the internal diameter of the apertures of the plurality of electrodes is arranged to progressively increase and then progressively decrease one or more times along the longitudinal axis of the device.

According to an embodiment the plurality of electrodes define a geometric volume, wherein the geometric volume is selected from the group consisting of: (i) one or more spheres; (ii) one or more oblate spheroids; (iii) one or more prolate spheroids; (iv) one or more ellipsoids; and (v) one or more scalene ellipsoids.

The Electron Transfer Dissociation reaction or fragmentation device preferably comprises a geometric volume defined by the internal diameters of the apertures of the plurality of electrodes wherein the geometric value is selected from the group consisting of: (i) <1.0 $cm^3$; (ii) 1.0-2.0 $cm^3$; (iii) 2.0-3.0 $cm^3$; (iv) 3.0-4.0 $cm^3$; (v) 4.0-5.0 $cm^3$; (vi) 5.0-6.0 $cm^3$; (vii) 6.0-7.0 $cm^3$; (viii) 7.0-8.0 $cm^3$; (ix) 8.0-9.0 $cm^3$; (x) 9.0-10.0 $cm^3$; (xi) 10.0-11.0 $cm^3$; (xii) 11.0-12.0 $cm^3$; (xiii) 12.0-13.0 $cm^3$; (xiv) 13.0-14.0 $cm^3$; (xv) 14.0-15.0 $cm^3$; (xvi) 15.0-16.0 $cm^3$; (xvii) 16.0-17.0 $cm^3$; (xviii) 17.0-18.0 $cm^3$; (xix) 18.0-

19.0 $cm^3$; (xx) 19.0-20.0 $cm^3$; (xxi) 20.0-25.0 $cm^3$; (xxii) 25.0-30.0 $cm^3$; (xxiii) 30.0-35.0 $cm^3$; (xxiv) 35.0-40.0 $cm^3$; (xxv) 40.0-45.0 $cm^3$; (xxvi) 45.0-50.0 $cm^3$; and (xxvii) >50.0 $cm^3$.

The device preferably comprises an effective ion trapping volume or region for an ion having a mass to charge ratio of 100, 200, 300, 400, 500, 600, 700, 800, 900 or 1000. The ion trapping volume or region within the device is preferably Selected from the group consisting of: (i) <1.0 $cm^3$; (ii) 1.0-2.0 $cm^3$; (iii) 2.0-3.0 $cm^3$; (iv) 3.0-4.0 $cm^3$; (v) 4.0-5.0 $cm^3$; (vi) 5.0-6.0 $cm^3$; (vii) 6.0-7.0 $cm^3$; (viii) 7.0-8.0 $cm^3$; (ix) 8.0-9.0 $cm^3$; (x) 9.0-10.0 $cm^3$; (xi) 10.0-11.0 $cm^3$; (xii) 11.0-12.0 $cm^3$; (xiii) 12.0-13.0 $cm^3$; (xiv) 13.0-14.0 $cm^3$; (xv) 14.0-15.0 $cm^3$; (xvi) 15.0-16.0 $cm^3$; (xvii) 16.0-17.0 $cm^3$; (xviii) 17.0-18.0 $cm^3$; (xix) 18.0-19.0 $cm^3$; (xx) 19.0-20.0 $cm^3$; (xxi) 20.0-25.0 $cm^3$; (xxii) 25.0-30.0 $cm^3$; (xxiii) 30.0-35.0 $cm^3$; (xxiv) 35.0-40.0 $cm^3$; (xxv) 40.0-45.0 $cm^3$; (xxvi) 45.0-50.0 $cm^3$; and (xxvii) >50.0 $cm^3$. The ion trapping volume or region is preferably significantly greater than that of a known 3D ion trap.

According to an embodiment the Electron Transfer Dissociation reaction or fragmentation device further comprises a device arranged and adapted to supply a first AC or RF voltage to the plurality of electrodes, wherein either:

(a) the first AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and/or (b) the first AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to the preferred embodiment in a mode of operation adjacent or neighbouring electrodes are supplied with opposite phases of the first AC or RF voltage.

According to an embodiment in a mode of operation the device may be operated in a quadrupolar or analytical mode of operation wherein either:

(a) a quadrupolar or substantially quadrupolar electric field is maintained along the axial direction of the device; and/or (b) a quadrupolar or substantially quadrupolar electric field is maintained along the radial direction of the device.

In a mode of operation an additional or auxiliary AC voltage may be applied between one or more upstream electrodes and one or more downstream electrodes in order:

(i) to excite ions resonantly or parametrically within the device; and/or (ii) to eject ions resonantly or parametrically from the device; and/or (iii) to fragment ions resonantly or parametrically within the device.

The Electron Transfer Dissociation reaction or fragmentation device may further comprise either:

(a) a device arranged and adapted to maintain a DC voltage or potential gradient along at least 5%, 10%, 15%, 20%, 25%, 30%, 35%, 40%, 45%, 50%, 55%, 60%, 65%, 70%, 75%, 80%, 85%, 90%, 95% or 100% of the length of the Electron Transfer Dissociation reaction or fragmentation device in a mode of operation; and/or (b) AC or RF voltage means arranged and adapted to apply two or more phase-shifted AC or RF voltages to electrodes forming at least part of the Electron Transfer Dissociation reaction or fragmentation device in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of the Electron Transfer Dissociation reaction or fragmentation device.

The DC voltage or potential gradient is preferably arranged in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of the Electron Transfer Dissociation reaction or fragmentation device.

According to an embodiment the device further comprises transient DC voltage means arranged and adapted to apply one or more transient DC voltages or potentials or one or more transient DC voltage or potential waveforms to at least some of the plurality of electrodes in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of the Electron Transfer Dissociation reaction or fragmentation device in a mode of operation.

The Electron Transfer Dissociation reaction or fragmentation device may further comprise means arranged and adapted to vary, increase or decrease the amplitude and/or velocity of the one or more transient DC voltages or potentials or the one or more transient DC voltage or potential waveforms with time. The amplitude and/or velocity of the one or more transient DC voltages or potentials or the one or more transient DC voltage or potential waveforms may be ramped, stepped, scanned or varied linearly or non-linearly with time.

In a mode of operation the one or more transient DC voltages or potentials or the one or more transient DC voltage or potential waveforms may be translated along the length of the Electron Transfer Dissociation, reaction or fragmentation device at a velocity selected from the group consisting of: (i) <100 m/s; (ii) 100-200 m/s; (iii) 200-300 m/s; (iv) 300-400 m/s; (v) 400-500 m/s; (vi) 500-600 m/s; (vii) 600-700 m/s; (viii) 700-800 m/s; (ix)800-900 m/s; (x) 900-1000 m/s; (xi) 1000-1100 m/s; (xii) 1100-1200 m/s; (xiii) 1200-1300 m/s; (xiv) 1300-1400 m/s; (xv) 1400-1500 m/s; (xvi) 1500-1600 m/s; (xvii) 1600-1700 m/s; (xviii) 1700-1800 m/s; (xix) 1800-1900 m/s; (xx) 1900-2000 m/s; (xxi) 2000-2100 m/s; (xxii) 2100-2200 m/s; (xxiii) 2200-2300 m/s; (xxiv) 2300-2400 m/s; (xxv) 2400-2500 m/s; (xxvi) 2500-2600 m/s; (xxvii) 2600-2700 m/s; (xxviii) 2700-2800 m/s; (xxix) 2800-2900 m/s; (xxx) 2900-3000 m/s; and (xxxi) >3000 m/s.

The Electron Transfer Dissociation reaction or fragmentation device is preferably maintained in use in a mode of operation at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-3}$ mbar; (xvi) $<10^{-4}$ mbar; (xvii)$<10^{-5}$ mbar; (xviii) $<10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

In a mode of operation singly charged ions having a mass to charge ratio in the range of 1-100, 100-200, 200-300, 300-400, 400-500, 500-600, 600-700, 700-800, 800-900, 900-1000 or >1000 are preferably arranged to have an ion residence time within the Electron Transfer Dissociation reaction or fragmentation device in the range: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-35 ms; (xxxii) 35-40 ms; (xxxiii) 40-45 ms; (xxxiv) 45-50 ms; (xxxv) 50-55 ms; (xxxvi) 55-60 ms; (xxxvii) 60-65 ms; (xxxviii) 65-70 ms; (xxxix) 70-75 ms; (xl) 75-80 ms; 80-85 ms; (xlii) 85-90 ms; (xliii) 90-95 ms; (xliv) 95-100 ms; and (xlv) >100 ms.

In a mode of operation ions are preferably collisionally cooled and/or thermalised by collisions with a gas within the Electron Transfer Dissociation reaction or fragmentation device.

According to an embodiment the Electron Transfer Dissociation reaction or fragmentation device preferably further comprises a cooling device for cooling the plurality of electrodes and/or a gas present within the device to a temperature selected from the group consisting of: (i) <20 K; (ii) 20-40 K; (iii) 40-60 K; (iv) 60-80 K; (v) 80-100 K; (vi) 100-120 K; (vii) 120-140 K; (viii) 140-160 K; (ix) 160-180 K; (x) 180-200 K; (xi) 200-220 K; (xii) 220-240 K; (xiii) 240-260 K; (xiv) 260-280 K; and (xv) 280-300K.

The device preferably further comprises a laser port wherein, in use, a laser beam is preferably transmitted via the laser port so as to fragment ions located within the device.

According to another aspect of the present invention there is provided a mass spectrometer comprising an Electron Transfer Dissociation reaction or fragmentation device as described above.

The mass spectrometer preferably further comprises a first ion guide arranged upstream of the Electron Transfer Dissociation reaction, or fragmentation device and/or a second ion guide arranged downstream of the Electron Transfer Dissociation reaction or fragmentation device. The first ion guide and/or the second ion guide preferably comprise:

(a) a quadrupole, hexapole, octapole or higher order rod set ion guide; and/or (b) a plurality of plate electrodes arranged generally in the plane of ion travel wherein adjacent electrodes are preferably maintained at opposite phases of an AC or RF voltage and wherein one or more ion guiding regions are formed within the ion guide; and/or (c) an ion guide having a Y-shaped coupling region wherein ions from a first ion source are transmitted, in use, to an outlet port of the ion guide and ions from a second separate ion source are transmitted, in use, to the outlet port of the ion guide.

The first ion guide and/or the second ion guide may comprise an ion tunnel ion guide comprising a plurality of electrodes having apertures through which ions are transmitted in use. The mass spectrometer preferably further comprises a device arranged and adapted to supply a second AC or RF voltage to the plurality of electrodes forming the first ion guide and/or the second ion guide, wherein either:

(a) the second AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix)400-450 V peak to peak; (x) 450-500 V peak to peak; and (xi) >500 V peak to peak; and/or (b) the second AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

In a mode of operation adjacent or neighbouring electrodes of the first ion guide and/or the second ion guide are supplied with opposite phases of the second AC or RF voltage.

The mass spectrometer preferably further comprises a first mass filter arranged upstream of the Electron Transfer Dissociation reaction or fragmentation device and/or a second mass filter arranged upstream of the Electron Transfer Dissociation reaction or fragmentation device. The first mass filter and/or the second mass filter are preferably selected from the group consisting of: (i) a quadrupole rod set mass filter; (ii) a Time of Flight mass filter; and (iii) a magnetic sector mass filter.

The mass spectrometer preferably further comprises either:

(a) a first ion source arranged upstream and/or downstream of the Electron Transfer Dissociation reaction or fragmentation device, wherein the first ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source; and/or (b) a second ion source arranged upstream and/or downstream of the Electron Transfer Dissociation reaction or fragmentation device, wherein the second ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source; and/or (c) an ion source arranged upstream and/or downstream of the Electron Transfer Dissociation reaction or fragmentation device which is arranged, in use, to produce positively charged analyte ions; and/or (d) an ion source arranged upstream and/or downstream of the Electron Transfer Dissociation reaction or fragmentation device which is arranged, in use, to produce negatively charged reagent ions.

The mass spectrometer may further comprise:

(a) an ion mobility separation device and/or a Field Asymmetric Ion Mobility Spectrometer device arranged upstream and/or downstream the Electron Transfer Dissociation reaction or fragmentation device; and/or (b) an ion trap or ion trapping region arranged upstream and/or downstream of the Electron Transfer Dissociation reaction or fragmentation device; and/or (c) a collision, fragmentation or reaction cell arranged upstream and/or downstream of Electron Transfer Dissociation reaction or fragmentation device, wherein the collision, fragmentation or reaction cell is selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions.

The mass spectrometer preferably further comprises a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

According to another aspect of the present invention there is provided a mass spectrometer comprising:

an Electron Transfer Dissociation reaction or fragmentation device comprising a plurality of electrodes; and an axial or orthogonal acceleration Time of Flight mass analyser arranged to receive ions from the Electron Transfer Dissociation reaction or fragmentation device;

wherein, in use, positively charged analyte ions are reacted and/or fragmented upon interaction with negatively charged reagent ions within the Electron Transfer Dissociation reaction or fragmentation device to form a plurality of fragment or product ions; and wherein the analyte ions and/or the reagent ions and/or the fragment or product ions are arranged to assume a mean kinetic energy selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; (xii) 55-60 meV; (xiii) 60-65 meV; (xiv) 65-70 meV; and (xv) >70 meV; and wherein the fragment or product ions are then transmitted to the Time of Flight mass analyser in order to be mass analysed.

According to another aspect of the present invention there is provided a method of reacting or fragmenting ions by Electron Transfer Dissociation, comprising:

providing a reaction or fragmentation device comprising a plurality of electrodes, wherein the device comprises at least five electrodes each having at least one aperture through which ions are transmitted; and reacting or fragmenting ions with reagent ions to form fragment or product ions with the device.

According to another aspect of the present invention there is provided a method of mass spectrometry, comprising a method as described above.

According to another aspect of the present invention there is provided a method of mass spectrometry comprising:

providing an Electron Transfer Dissociation reaction or fragmentation device comprising a plurality of electrodes; and providing an axial or orthogonal acceleration Time of Flight mass analyser arranged to receive ions from the Electron Transfer Dissociation reaction or fragmentation device;

reacting and/or fragmenting positively charged analyte ions with negatively charged reagent ions within the Electron Transfer Dissociation reaction or fragmentation device to form a plurality of fragment or product ions, wherein the analyte ions and/or reagent ions and/or fragment or product ions are arranged to assume a mean kinetic energy selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; (xii) 55-60 meV; (xiii) 60-65-meV; (xiv) 65-70 meV; and (xv) >70 meV; and transmitting the fragment or product ions to the Time of Flight mass analyser in order to be mass analysed.

According to another aspect of the present invention there is provided a Proton Transfer reaction or fragmentation device comprising a plurality of electrodes, wherein the device comprises at least five electrodes each having at least one aperture through which ions are transmitted in use.

According to another aspect of the present invention there is provided a method of reacting or fragmenting ions by Proton Transfer reaction or fragmentation, comprising:

providing a reaction or fragmentation device comprising a plurality of electrodes, wherein the device comprises at least five electrodes each having at least one aperture through which ions are transmitted; and reacting or fragmenting ions with reagent ions to form fragment or product ions with the device.

All of the preferred features described above in relation to an Electron Transfer Dissociation reaction or fragmentation device are equally applicable to a Proton Transfer reaction or fragmentation device as described above and hence for reasons of economy will not be repeated.

According to an aspect of the present invention there is provided an ion-ion reaction or fragmentation device comprising a plurality of electrodes having one or more apertures through which ions are transmitted in use wherein analyte ions and/or reagent ions and/or fragment or product ions created within the device are arranged to assume a mean kinetic energy selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV.

The reaction or fragmentation device preferably comprises an Electron Transfer Dissociation reaction or fragmentation device and/or a Proton Transfer reaction or fragmentation device.

According to an aspect of the present invention there is provided a method of reacting or fragmenting ions by ion-ion interaction comprising:

providing a plurality of electrodes having one or more apertures through which ions are transmitted; and causing analyte ions and/or reagent ions and/or fragment or product ions created within the device to assume a mean kinetic energy selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV.

According to an aspect of the present invention there is provided a method of Electron Transfer Dissociation reaction or fragmentation and/or Proton Transfer reaction or fragmentation comprising a method as described above.

According to an aspect of the present invention there is provided a mass spectrometer comprising an Electron Transfer Dissociation device, a Proton Transfer reaction device or an ion-ion interaction device which is arranged to cool analyte ions and/or reagent ions and/or fragment or product ions to a kinetic energy <40 meV, <45 meV, <50 meV, <55 meV or <60 meV and to transmit fragment or product ions to a Time of Flight mass analyser.

According to an aspect of the present invention there is provided a method of mass spectrometry comprising cooling analyte ions and/or reagent ions and/or fragment or product ions to a kinetic energy <40 meV, <45 meV, <50 meV, <55 meV or <60 meV within an Electron Transfer Dissociation device, a Proton Transfer reaction device or an ion-ion interaction device and then transmitting fragment or product ions to a Time of Flight mass analyser.

According to an aspect of the present invention there is provided an Electron Transfer Dissociation device, a Proton Transfer reaction device or an ion-ion interaction device comprising a plurality of electrodes each having an aperture through which ions are transmitted in use and wherein in a mode of operation ions are confined radially and/or axially within the device and a substantially electric field free region is formed or created within or throughout at least 5%, 10%, 15%, 20%, 25%, 30%, 35%, 40%, 45%, 50%, 55%, 60%, 65%, 70%, 75%, 80%, 85% or 90% of the volume defined by the internal diameters of the plurality of electrodes.

According to an aspect of the present invention there is provided a method of Electron Transfer Dissociation, Proton Transfer reaction or ion-ion interaction comprising:

providing a plurality of electrodes each having an aperture through which ions are transmitted;

confining ions radially and/or axially within the device; and forming or creating a substantially electric field free region within or throughout at least 5%, 10%, 15%, 20%, 25%, 30%, 35%, 40%, 45%, 50%, 55%, 60%, 65%, 70%, 75%, 80%, 85% or 90% of the volume defined by the internal diameters of the plurality of electrodes.

According to the preferred embodiment of the present invention there is provided a reaction or fragmentation chamber or cell which preferably has a relatively high charge capacity (in contrast to a conventional 3D ion trap which has a limited charge capacity).

According to the preferred embodiment the preferred reaction or fragmentation device traps or confines ions such that ions preferably exhibit very low (or effectively zero) micro-motion at the centre of the device and throughout most of the ion confinement volume. Ions at the centre of the preferred device and throughout the central volume of the device are therefore preferably unaffected by RF confining electric fields and hence the ions preferably do not suffer from RF heating effects. RF heating is where ions experience an RF electric field and are caused to undergo micro-motion. The resulting agitation or excitation of the ions within the RF electric field causes the mean kinetic energy of the ions to rise above thermal levels.

The reaction or fragmentation device according to the preferred embodiment preferably overcomes problems with the very low fragmentation cross-section which is observed in a conventional 3D ion trap. Furthermore, the preferred reaction or fragmentation device also provides a larger ion trapping volume than conventional 2D or linear ion traps and 3D ion traps.

According to an embodiment the preferred reaction or fragmentation device or chamber comprises a spherical or ellipsoid chamber formed within a stacked ring ion guide or ion tunnel ion guide.

Various embodiments of the present invention will now be described, by way of example only, and with reference to the accompanying drawings in which.

Figure 3A:
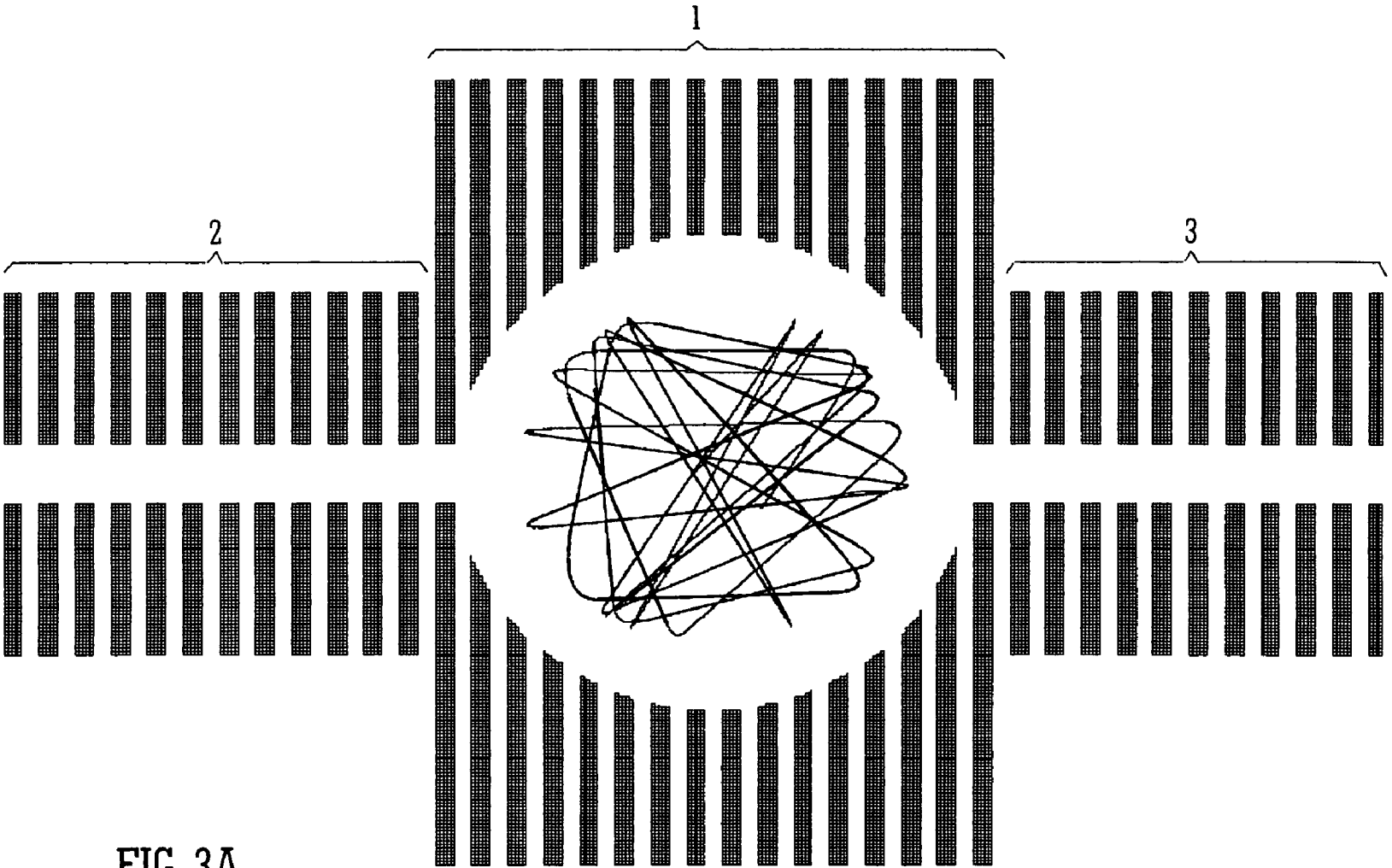
Figure 3B:
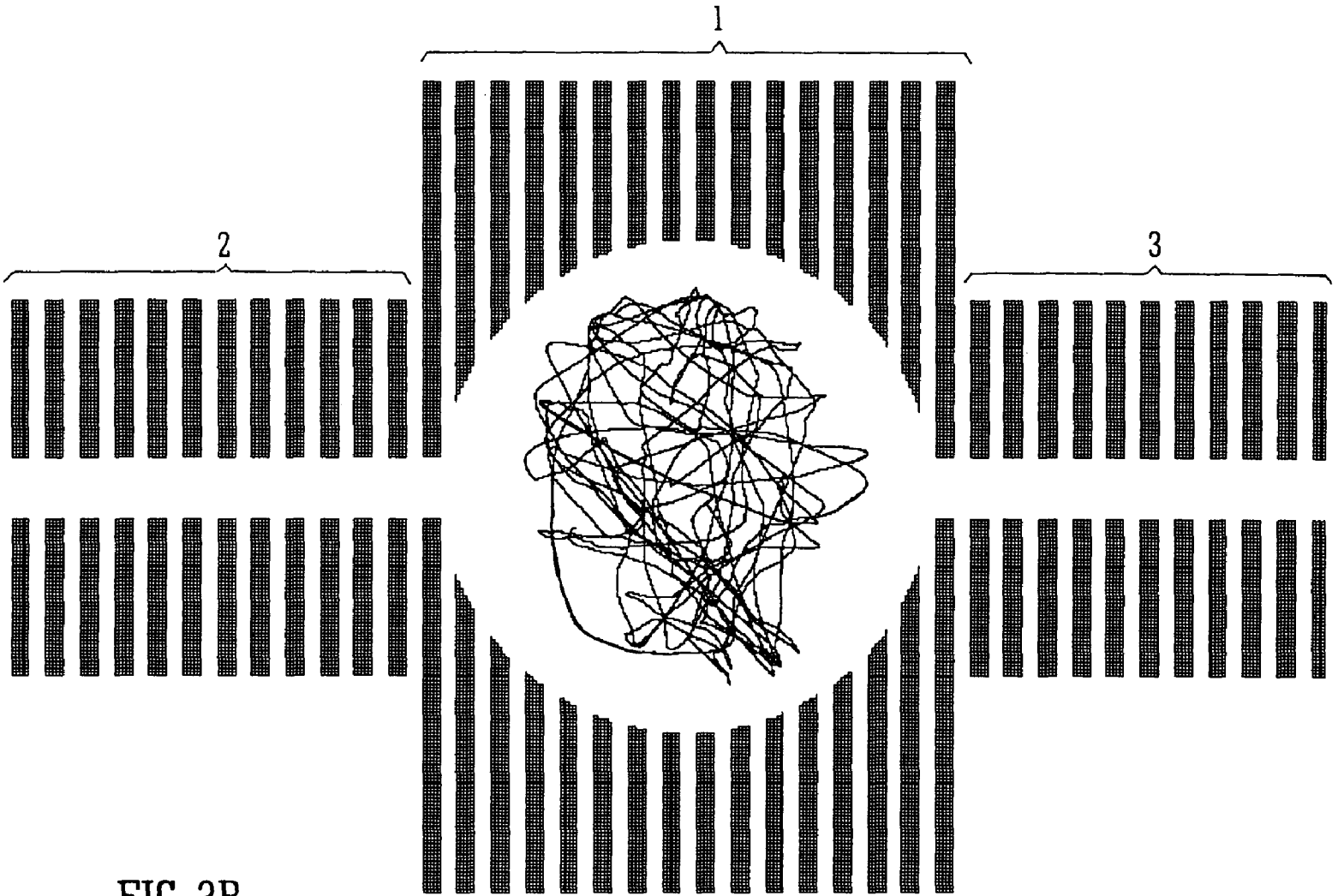
Figure 4:
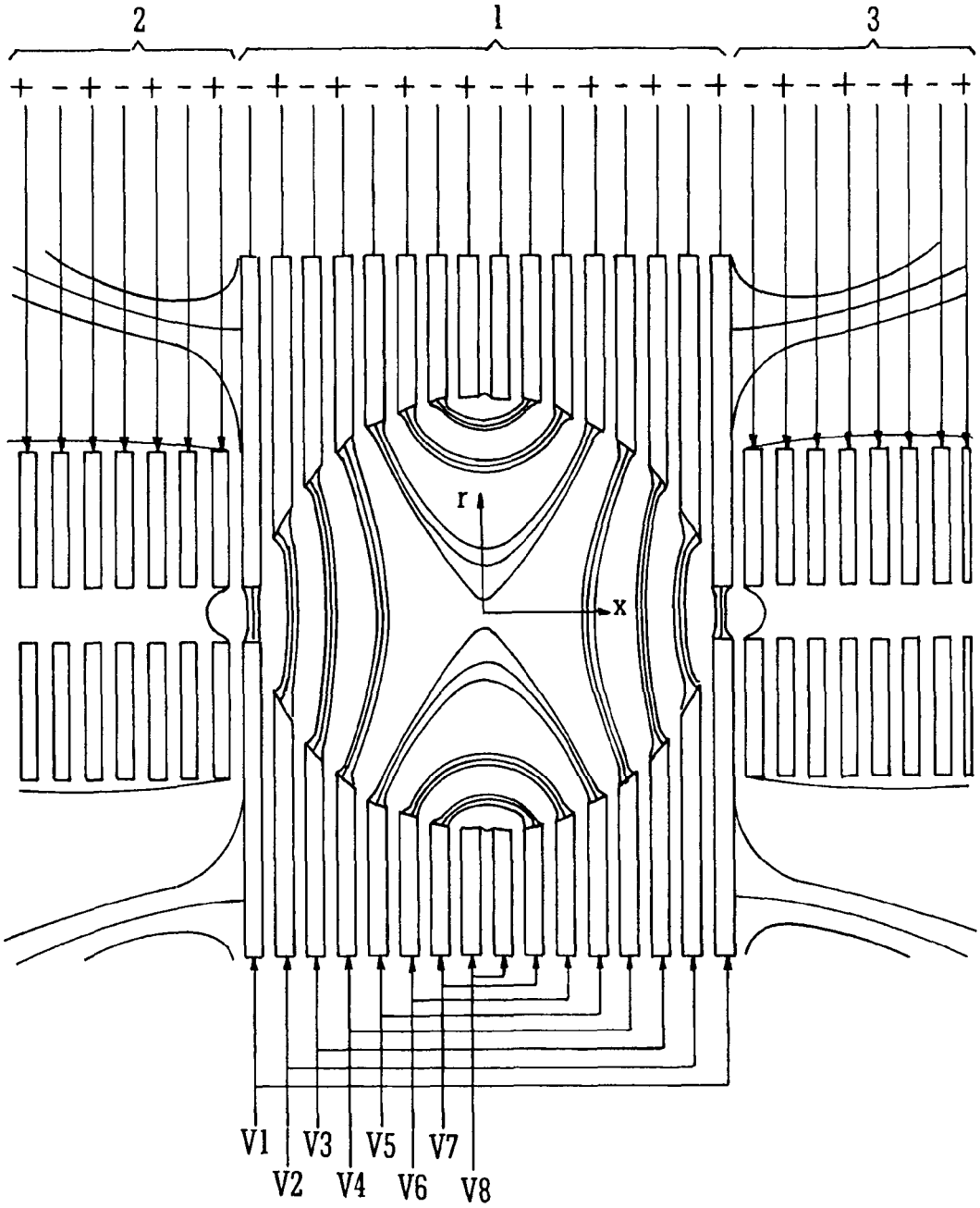
Figure 5:
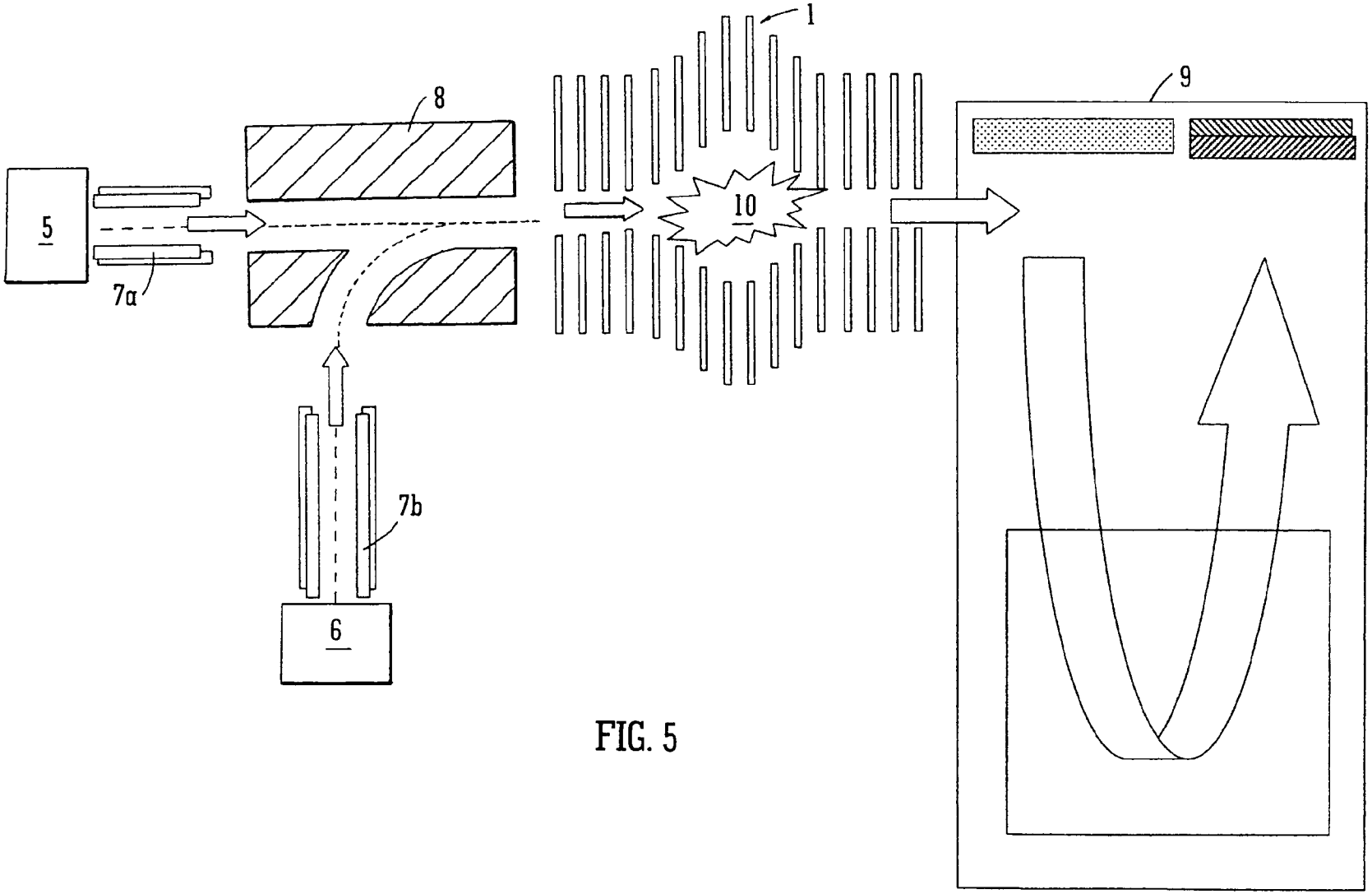

FIG. 3A shows the result of a simulation of ion motion of ions provided within a preferred reaction or fragmentation cell in the absence of any background gas and FIG. 3B shows the result of a simulation of ion motion of ions provided within a preferred reaction or fragmentation cell wherein background gas having a pressure of 5 mTorr is modelled as being present within the preferred reaction or fragmentation cell;

FIG. 4 shows a preferred reaction or fragmentation cell operated in a second or analytical mode of operation after ions have been reacted or fragmented so as to form fragment or product ions by Electron Transfer Dissociation wherein in the second or analytical mode a quadrupolar electric field is established across the ion confinement volume; and FIG. 5 shows an embodiment of the present invention wherein a preferred reaction or fragmentation cell is incorporated into a mass spectrometer comprising separate anion and cation sources, a Y-shaped ion guide upstream of the preferred reaction or fragmentation cell and a Time of Flight mass analyser arranged downstream of the preferred reaction or fragmentation cell.

Figure 1:
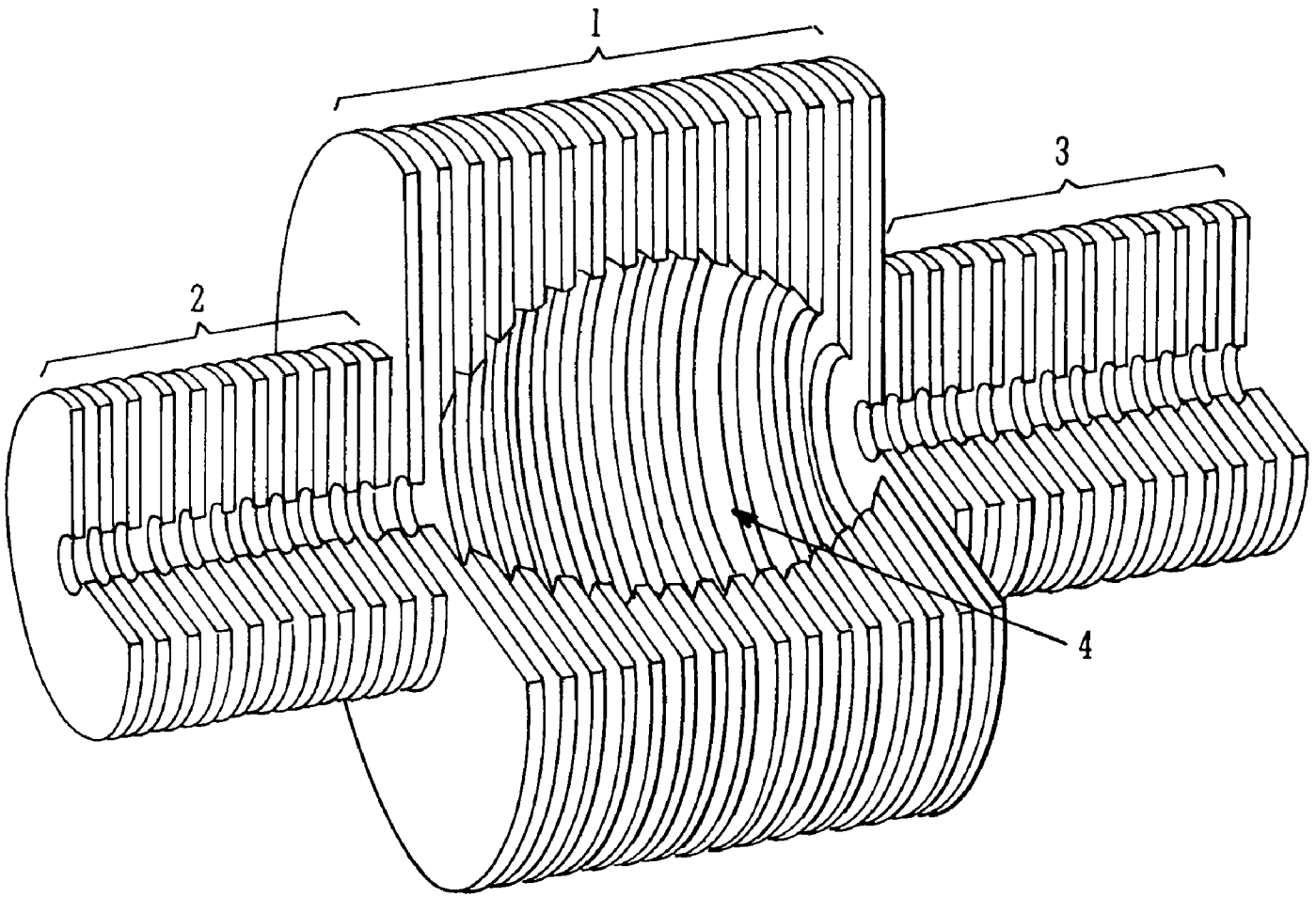
FIG. 1 shows a preferred reaction or fragmentation cell formed within a plurality of ring electrodes together with an upstream ion tunnel ion guide and a downstream ion tunnel ion guide.

A preferred embodiment of the present invention will now be described with reference to FIG. 1. FIG. 1 shows a cutaway image of a preferred reaction or fragmentation cell 1 formed by a plurality of electrodes having internal apertures which define an ion trapping volume. An upstream ion tunnel ion guide 2 comprising a plurality of electrodes having apertures through which ions are transmitted in use is shown. A downstream ion tunnel ion guide 3 comprising a plurality of electrodes having apertures through which ions are transmitted in use is also shown.

The preferred reaction or fragmentation cell 1 as shown in FIG. 1 is taken from a SIMION® model and illustrates the geometry of a reaction or fragmentation cell 1 according to a preferred embodiment of the present invention wherein the reaction or fragmentation cell is coupled to stacked ring ion tunnel ion guides 2,3 which are arranged upstream and downstream of the preferred reaction or fragmentation cell 1. According to the preferred embodiment the volume defined by the internal apertures of the electrodes is preferably spherical. However, other embodiments are contemplated wherein the ion trapping volume may have a general ellipsoid or other shape or volume profile.

An AC or RF voltage is preferably applied to the electrodes forming the preferred reaction or fragmentation device or cell 1. In a first or Electron Transfer Dissociation fragmentation or reaction mode of operation opposite phases of the AC or RF voltage are preferably applied to adjacent electrodes.

The diameter of the internal sphere or ion trapping volume or region is preferably sufficiently large such that the pseudo-potential generated by the application of the AC or RF voltage to the electrodes merely acts as an RF barrier or pseudo-potential at the surface of the reaction volume. The geometry of the reaction cell 1 and the depth of penetration of the RF electric field into the ion confinement volume is preferably such that ion micro-motion as a result of ions interacting within the AC or RF voltage effectively decays to zero over the central volume or region of the fragmentation or reaction device 1. According to the preferred embodiment the central region and the majority of the ion confinement volume of the fragmentation or reaction device 1 is essentially field free. Ion micro-motion is proportional to the strength of a pseudo-potential experienced by an ion and hence if the pseudo-potential experienced by an ion within the ion trapping region is essentially zero then the ion does not exhibit any micro-motion. As a result of the lack of ion micro-motion the mean kinetic energy of the ions drops to a relatively low level which is preferably just above the thermal temperature of any background gas present within the ion trap or fragmentation or reaction device 1.

With reference to the embodiment shown in FIG. 1, positively charged analyte ions may be introduced into the preferred ion trap or ion fragmentation or reaction device 1 via a first (upstream) ion guide 2 and negatively charged reagent ions may be introduced into the preferred ion trap or ion fragmentation or reaction device 1 via a second (downstream) ion guide 3 or vice versa. Other embodiments are contemplated wherein positively and negatively charged ions may be introduced into the ion trap 1 via the same ion guide 2; 3. For example, positive and negative ions may be introduced into the ion trap 1 via the first (upstream) ion guide 2 and/or the second (downstream) ion guide 3.

One or more transient DC voltages or DC voltage waveforms may be applied to either the first (upstream) ion guide 2 and/or the second (downstream) ion guide 3 in order to force, urge, drive or propel ions along the length of the ion guide 2,3 and into the ion trap 1. Alternatively or in addition, one or more DC voltages may be applied along at least a portion of the first and/or second ion guides 2,3 in order to force, urge, drive or propel ions along the length of the ion guide 2,3 and into the ion trapping region 1.

Figure 2A:
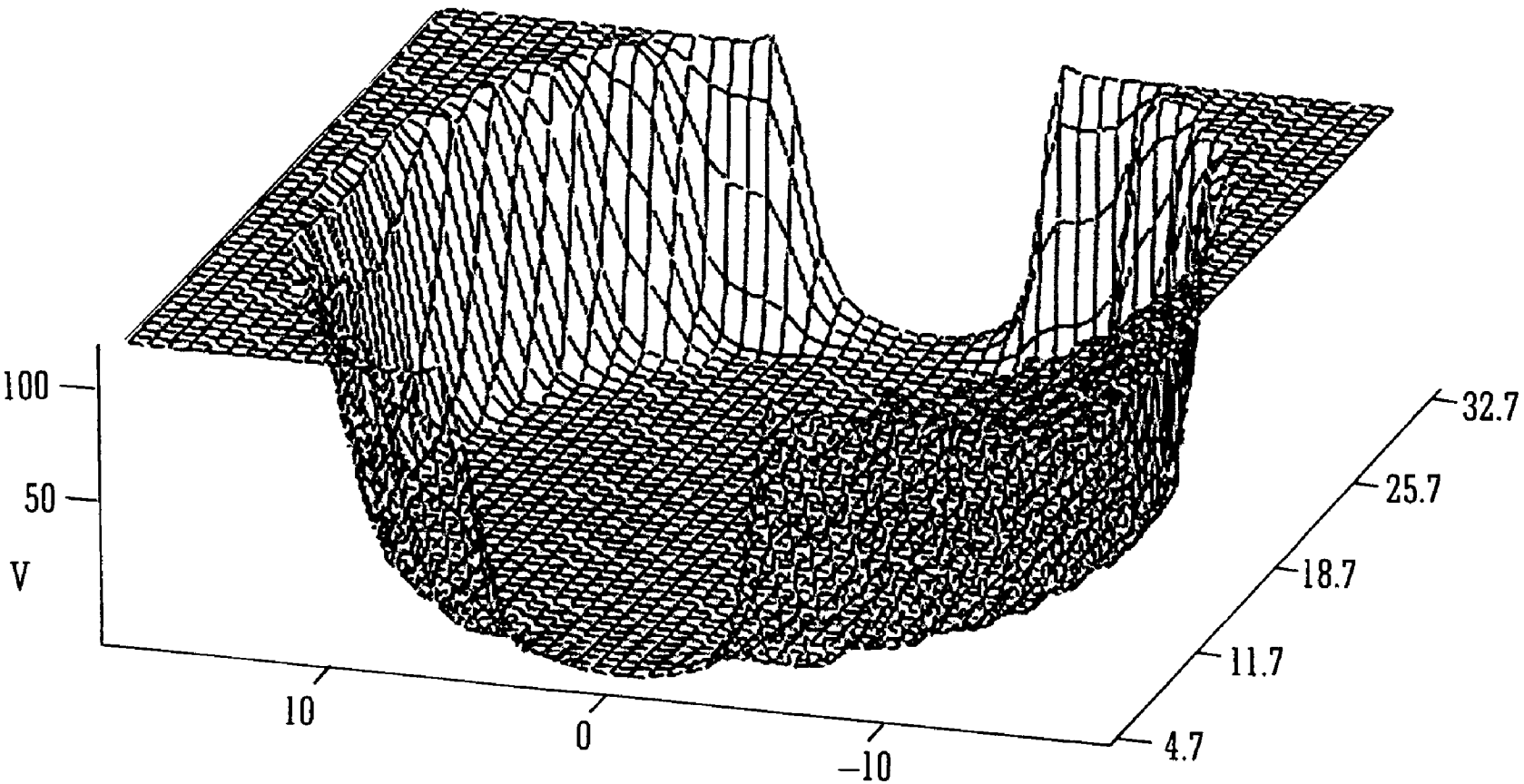
FIG. 2A shows a pseudo-potential plot across a preferred reaction or fragmentation cell and FIG. 2B shows a pseudo-potential plot in greater detail across the central region of the preferred reaction or fragmentation cell.
Figure 2B:
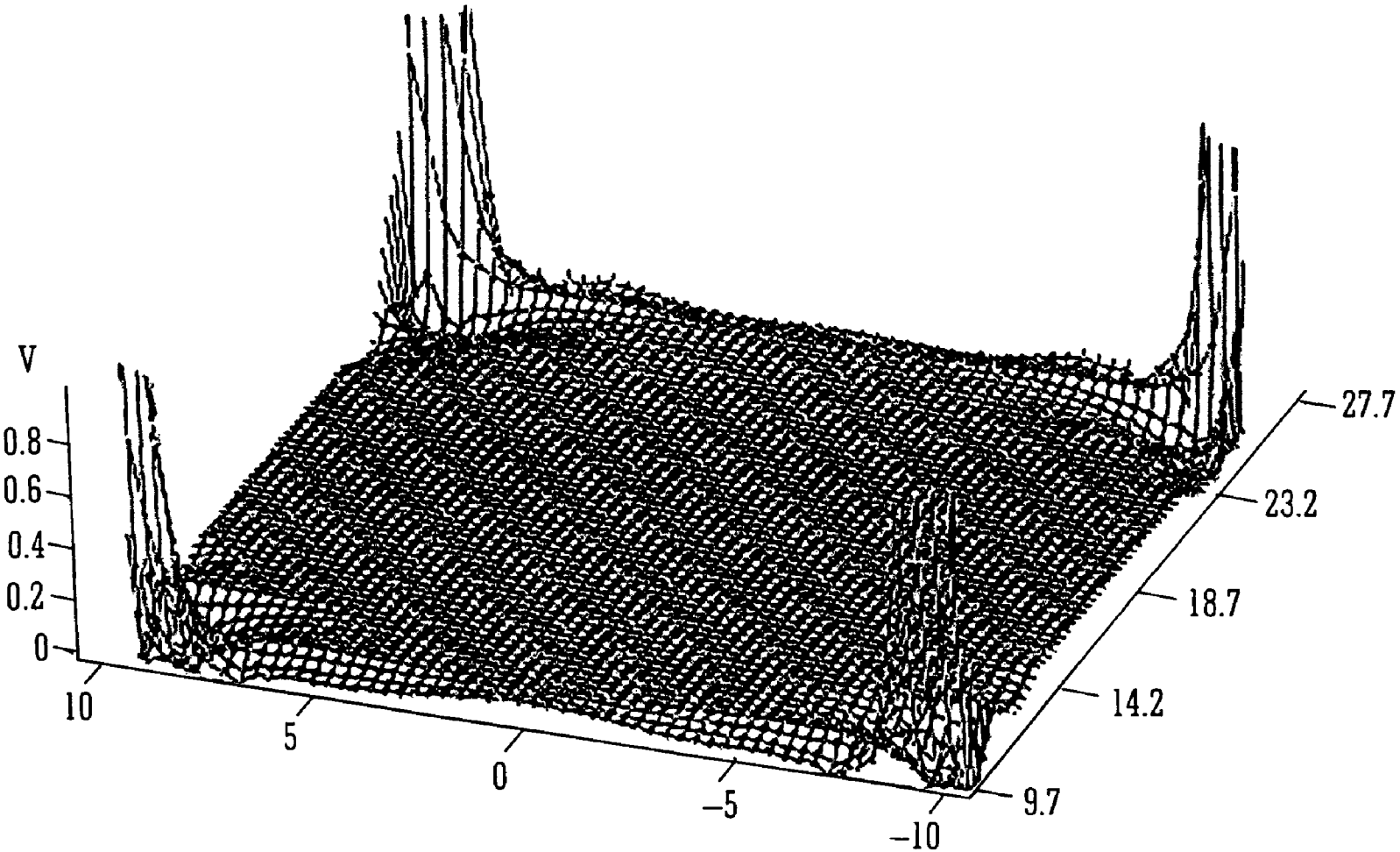

FIGS. 2A and 2B show the results of SIMION® modeling of the pseudo-potential surface within the preferred ion trap 1. The pseudo-potential in Volts is shown along the vertical scale relative to the XY plane position (mm) within the preferred reaction cell 1. As can be seen from FIGS. 2A and 2B, according to the preferred embodiment a substantial proportion of the ion trapping volume of the preferred ion trap has a zero or negligible pseudo-potential. Therefore, ions for a majority of their time within the ion trapping region do not experience an RF electric field. The ions are therefore enabled to assume mean kinetic energies which are substantially similar to those of the background gas molecules present within the ion trap 1.

FIG. 3A illustrates ion motion as modelled by SIMION® within the preferred reaction cell 1 in the absence of background gas. As shown in FIG. 3A, with no gas present in the model, ions travel in straight lines across the ion trapping region indicating that the only significant electric fields which the ions experience is the pseudo-potential electric field present at the edge or outer surface of the spherical ion confinement volume wherein ions are reflected back towards the centre of the ion trap 1. FIG. 3A therefore illustrates that a very low or negligible pseudo-potential is present over the majority of the ion trapping region of the device 1 i.e. ions travel in straight lines between reflections at the outer surface of the ion trapping volume in the absence of background gas.

FIG. 3B shows the result of simulated ion motion as modelled by SIMION® wherein ions are modelled as being confined within the ion trap 1 and wherein 5 mTorr of helium background gas is modelled as being present. When background gas is included in the model then ions generally attain the thermal energy of the collision gas present within the ion trap 1. Ion motion is substantially dominated by collisions with the background gas molecules and ions exhibit very little RF heating effects.

In order to quantify the relative collision rate constant for a conventional 3D ion trap, a conventional 2D ion trap and a reaction cell 1 according to a preferred embodiment ion-ion collisions within a 3D ion trap, a 2D ion trap and a reaction cell 1 according to the preferred embodiment were modelled using SIMION®. The mean kinetic energy and the mean relative speed between a pair of opposing polarity ions was recorded in each case. The model assumed that two ions were present. One of the ions had 3+ charge and a mass of 2500 and the other ion had a charge of −1 and a mass of 80. In all cases a bath gas was modelled as being present. The bath gas was modelled as comprising helium gas which was present at a pressure of 5 mTorr.

For the model of the conventional 3D ion trap +/−60V RF was modelled as being applied to the ring electrode at a frequency of 1 MHz. For the model of the conventional 2D ion trap +/−60V RF was modelled as being applied at a frequency of 1 MHz to opposing poles with end plates supplied with +/−60V at a frequency of 200 kHz. In order to simulate a reaction cell 1 according to a preferred embodiment +/−100V RF was modelled as being applied to adjacent plates or ring electrodes forming the ion trap 1.

The relative collision rate constant was then calculated based on the mean ion-ion speed measurements. The following table summarises the SIMION® results where ions were flown for 100 ms.

| | Mean KE (meV) | Mean ion-ion speed (m/s) | Relative Collision Rate Constant |
|---|---|---|---|
| 3D Trap | 90.6 | 434.5 | 0.8 |
| 2D Trap | 74.7 | 407.4 | 1 |
| Preferred Reaction Cell | 43.4 | 304.4 | 2.4 |

The above table shows that there is a slight improvement in using a conventional 2D ion trap compared with a conventional 3D ion trap when seeking to induce ion-ion fragmentation. More significantly, there is a significant improvement in the ion-ion collision rate and hence the number of analyte ions which are fragmented when using a reaction or fragmentation cell 1 according to the preferred embodiment as compared with using a conventional 2D ion trap.

Ion micro-motion and RF heating effects of ions within the preferred reaction cell 1 is significantly lower than is the case when using a conventional 2D or 3D quadrupole ion trap. The SIMION® results indicate that the mean kinetic ion energy (43.4 meV) of the ions within the preferred reaction cell 1 is almost as low as the thermal energy of the helium bath gas (38 meV). This is because with conventional 2D and 3D quadrupole ion traps the randomised motion caused by the gas collisions pushes ions into the RF fields which has the effect of magnifying the effect of RF heating. However, ions within the preferred ion trap 1 are substantially immune from the effects of RF heating.

As a consequence of the reduced relative ion speed, the ion-ion collision rate constant for Electron Transfer Dissociation is significantly higher for the preferred reaction cell 1 than for either a conventional 2D or 3D quadrupole ion trap. Electron Transfer Dissociation performed within the preferred ion trap 1 is therefore significantly more sensitive than comparable experiments performed within a conventional 2D or 3D ion trap.

According to an embodiment of the present invention analyte and reagent ions may be sent or ejected into the preferred reaction cell from either end of the fragmentation or reaction device 1. Ions may be transmitted to the preferred reaction cell 1 by, for example, applying travelling wave DC potentials along the ion tunnel/reaction chamber/ion tunnel combination. According to this embodiment one or more transient DC voltages or potentials or one or more transient DC voltage or potential waveforms are preferably applied to the electrodes comprising the ion guides 2,3 and/or the preferred reaction chamber 1. A particularly advantageous feature of such travelling wave devices is that both positive and/or negative polarity ions may be carried along the length of the ion guide(s) 2,3 and/or the preferred reaction chamber 1 by a travelling wave moving in the same direction. Positive ions may be carried in the troughs of the travelling wave and negative ions may be carried in the crests of the travelling wave.

According to another embodiment a DC bias voltage may be applied to the electrodes comprising the ion guides 2,3 and/or the electrodes comprising the reaction chamber 1 in order to cause ions to drift into and/or out from the preferred reaction chamber 1.

According to an embodiment the RF voltages applied to the rings of the reaction chamber 1 may be switched electronically from a first mode of operation to a second mode of operation. In the first mode of operation the reaction chamber 1 is preferably operated in a cold trap mode of operation wherein +/−100V is applied to adjacent plate electrodes. In this mode of operation ion-ion reactions are preferably optimised.

In the second or analytical mode of operation the reaction chamber 1 is preferably switched to operate in an analytical trapping mode wherein the AC or RF voltages applied to the reaction chamber 1 are preferably rearranged so that a quadrupolar RF electric field is preferably provided throughout the ion trapping region. In the second mode of operation ions may be scanned out of the preferred reaction chamber 1 by mass selective instability or resonance excitation.

According to an embodiment the reaction chamber 1 may be operated in the second (analytical) mode of operation prior to operating the reaction chamber 1 in the first mode of operation wherein analyte ions are fragmented by Electron Transfer Dissociation. According to an embodiment only desired reagent ions may be retained within the reaction chamber 1 prior to Electron Transfer Dissociation of analyte ions. All other potential reagent ions may be mass selectively ejected from the preferred ion trap 1 prior to Electron Transfer Dissociation reaction or fragmentation being performed i.e. operating the preferred device in the first mode of operation.

The preferred ion trap 1 may be switched into the second (analytical) mode of operation after or subsequent to performing Electron Transfer Dissociation reaction or fragmentation within the preferred ion trap 1 (i.e. operating the ion trap 1 in the first mode of operation). Product or fragment ions formed within the ion trap 1 can be scanned out from the preferred reaction or fragmentation device 1 into or towards an ion detector or a Time of Flight mass spectrometer or mass analyser.

According to an embodiment a pseudo potential driving force may be used to drive ions into and/or out from the preferred reaction cell 1. This may be achieved by changing the shape of the sphere-elliptical or ion trapping volume where the changes in field are more gradual into and out of the ion trap.

When the preferred fragmentation or reaction device 1 is operated in the first or Electron Transfer Dissociation mode of operation wherein it is desired to minimise the relative ion motion between anions and cations then alternate phases of an AC or RF voltage are preferably applied to alternate ring electrodes throughout the device. This is illustrated in FIG. 4 wherein opposite phases of the AC or RF voltage are denoted by +,− symbols.

As discussed above, the preferred fragmentation or reaction device 1 may also be operated in a second different mode of operation wherein the preferred fragmentation or reaction device 1 is operated in an analytical mode of operation. According to this mode of operation the AC or RF voltage which is otherwise applied to alternate ring electrodes which form or define the fragmentation or reaction device 1 is preferably switched OFF. In the second or analytical mode of operation a different voltage function may preferably be applied to the electrodes so that a quadratic potential or a substantially quadratic potential is preferably created or maintained within the preferred fragmentation or reaction device 1. According to this embodiment the potential within the preferred fragmentation or reaction device 1 is preferably proportional to the axial dimension $x^2$ and the radial dimension $r^2$.

In the second or analytical mode of operation a plurality of voltages Vn may be applied to the ring electrodes forming the preferred fragmentation or reaction device 1. The voltages are preferably maintained or applied to the ring electrodes using or via a resistive and capacitative network wherein the highest voltage applied to the ring electrodes is $Vn_{max}$ and the lowest voltage applied to the ring electrodes is V1. As shown in FIG. 4, V1 preferably corresponds to the voltage applied to the electrode at the upstream and downstream end of the preferred reaction or fragmentation device 1. In the particular example shown in FIG. 4, $n_{max}$ equals eight. However, other embodiments are contemplated wherein the preferred ion trap 1 may comprise fewer or greater than 16 electrodes.

Models of the preferred fragmentation or reaction device 1 using SIMION® indicate that a substantially quadratic electric field may be obtained in both the axial (x) and radial (r) directions when the voltages Vn are applied proportionally with n. In order to generate a pseudo-potential wherein ions are trapped within the preferred fragmentation or reaction device 1 the voltages Vn are preferably multiplied by a sin (w*t) function wherein w is the frequency of the voltage function with time (t).

According to the preferred embodiment when the preferred fragmentation or reaction device 1 is operated in the second or analytical mode of operation the device behaves like a 3D quadrupolar (or Paul) ion trap. Further supplementary voltage functions may be applied to the plates or electrodes forming the preferred ion trap 1 in order to cause ions to be mass selectively ejected by resonance ejection in an axial direction when the ion trap 1 is operated in the second or analytical mode of operation.

The analytical mode of operation described above provides an additional mode of operation whereby Electron Transfer Dissociation product or precursor ions may be further manipulated and swept out in a mass selective manner into or towards either an ion detector or a mass analyser.

Embodiments are also contemplated wherein the preferred reaction cell 1 may be filled with a lower temperature gas by, for example, admitting vapour from liquid nitrogen (77K) or by cooling the plates of the ion tunnel or ion trap 1 directly with liquid nitrogen. According to this embodiment the mean kinetic energy of ions within the preferred reaction cell 1 is preferably arranged to be very low relative to conventional 2D or 3D ion traps. The preferred reaction cell 1 is particularly advantageous in terms of conditioning ions by cooling them to near thermal levels before transmitting the ions onwardly to a mass analyser such as an orthogonal acceleration Time of Flight (TOF) mass analyser. The ultimate mass resolving power of an orthogonal acceleration Time of Flight mass analyser is limited by the orthogonal energy spread within the ion beam which is sampled periodically by the mass analyser.

According to the preferred embodiment ions may be collisionally damped at room or lower temperatures upstream of the orthogonal acceleration stage of an orthogonal acceleration Time of Flight mass analyser or mass spectrometer and prior to application of a pushout field or orthogonal acceleration pulse to a packet of ions or an ion beam. The cooling of the ions to near thermal temperatures advantageously reduces the orthogonal energy spread of the ions. This has the effect of reducing the turn around time aberration in the Time of Flight mass analyser. As a result, the resolution of the mass analyser is preferably significantly improved.

If the RF heating of ions is negligible within the preferred reaction or fragmentation device 1 then the turn around time aberration will be proportional to the velocity spread which will be proportional to the square root of the temperature of the cooling gas. Therefore, reducing the thermal energy by a factor ×4 (e.g. by reducing the temperature from room temperature to liquid nitrogen temperature) will reduce the ion velocity spread and hence the turn around time by a factor ×2 and hence will increase the ultimate mass resolving power of the orthogonal acceleration mass spectrometer by a factor of ×2.

According to the preferred embodiment the preferred reaction cell 1 is able to produce high quality Electron Transfer Dissociation MS/MS data and enables increased resolution mass spectral data to be obtained when the preferred reaction cell is coupled to an orthogonal acceleration Time of Flight mass spectrometer.

Further embodiments of the present invention are contemplated wherein a laser port may be provided to enable photofragmentation of ions within the preferred ion trap 1.

According to an embodiment one or more dipolar fields may be used to control (e.g. increase or decrease) kinetic energies within the preferred ion trap 1. Therefore, for example, according to an embodiment the ion trap 1 may be operated in a mode of operation wherein an additional AC voltage is applied across the ends of the ion trap 1 which causes ions to be excited resonantly. Ions may therefore be caused to undergo Collision Induced Dissociation or Decomposition (CID) within the preferred ion trap 1.

It is advantageous although not essential to generate cation analytes (i.e. positively charged analyte ions) and reagent anions (i.e. negatively charged reagent ions) from different ion sources. According to an embodiment an ion guide may be utilised which preferably simultaneously and continuously receives and transfers ions of either polarity from multiple ion sources at different locations. The ion guide may, for example, comprise an ion guide comprising a plurality of plate electrodes arranged generally in the plane of ion travel. Opposite phases of an AC or RF voltage may be applied to adjacent electrodes. One or more ion guiding regions may be shaped or formed within the ion guide. The ion guide may according to one embodiment comprise a Y-shaped coupler wherein ions from an anion ion source and ions from a cation ion source pass through the Y-shaped ion guide before being injected via a common ion injection port into a preferred reaction or fragmentation cell 1.

A mass spectrometer according to a preferred embodiment is shown in FIG. 5. As shown in FIG. 5, an ion guide 8 may be utilised to introduce both cations and anions into the entrance region of a preferred fragmentation or reaction device 1. A mass or mass to charge ratio selective quadrupole 7*a* may be provided between an anion source 5 and the ion guide 8. Additionally or alternatively, a mass or mass to charge ratio selective quadrupole 7*b* may be provided between a cation source 6 and the ion guide 8. The two quadrupole rod sets 7*a*,7*b* preferably enable appropriate or desired analyte ions and/or appropriate or desired reagent ions produced from the ion sources 5,6 to be transmitted onwardly to the ion guide 8 and hence to the preferred ion trap 1.

According to a preferred embodiment an orthogonal acceleration Time of Flight mass analyser 9 may be arranged downstream of the preferred reaction or fragmentation device 1 in order to receive and mass analyse product or fragment ions 10 which are created within the preferred ion-ion reaction device 1 and which are then ejected from the ion-ion reaction device 1 for subsequent mass analysis.

Although the present invention has been described with reference to preferred embodiments, it will be understood by those skilled in the art that various changes in form and detail may be made to the particular embodiments discussed above without departing from the scope of the invention as set forth in the accompanying claims.

The invention claimed is:

1. An Electron Transfer Dissociation fragmentation device comprising a plurality of electrodes, wherein said device comprises at least five electrodes each having at least one aperture through which ions are transmitted in use; wherein the internal diameter of the apertures of the plurality of electrodes progressively increases and then progressively decreases one or more times along the longitudinal axis of said device.

2. An Electron Transfer Dissociation fragmentation device as claimed in claim 1, wherein:

(a) analyte ions or reagent ions or fragment ions created within said device are arranged to assume a mean kinetic energy within said device selected from the group consisting of: (i)<5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV; or (b) in use, a neutrally charged bath gas is provided within said device and wherein gas molecules of said neutrally charged bath gas are arranged to assume a first mean kinetic energy and wherein analyte ions, reagent ions or fragment ions created within said device are arranged to assume a second mean kinetic energy within said device, wherein the difference between said second mean kinetic energy and said first mean kinetic energy is selected from the group consisting of: (i)<5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV; or (c) in use, a neutrally charged bath gas is provided within said device and wherein gas molecules of said neutrally charged bath gas possess a thermal energy and wherein analyte ions or reagent ions or fragment ions created within said device are arranged to assume a mean kinetic energy within said device, wherein either:

(i) the difference between the mean kinetic energy of said ions and said thermal energy of said bath gas is selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; and (xii) 55-60 meV; or (ii) the ratio of the mean kinetic energy of said ions to the thermal energy of said bath gas is selected from the group consisting of: (i) <1.05; (ii) 1.05-1.1; (iii) 1.1-1.2; (iv) 1.2-1.3; (v) 1.3-1.4; (vi) 1.4-1.5; (vii) 1.5-1.6; (viii) 1.6-1.7; (ix) 1.7-1.8; (x) 1.8-1.9; (xi) 1.9-2.0; (xii) 2.0-2.5; (xiii) 2.5-3.0; (xiv) 3.0-3.5; (xv) 3.5-4.0; (xvi) 4.0-4.5; (xvii) 4.5-5.0; and (xviii)>5.0.

3. An Electron Transfer Dissociation fragmentation device as claimed in claim 1, wherein either:

(a) the internal diameter of the apertures of said plurality of electrodes progressively increases and then progressively decreases one or more times along the longitudinal axis of said device; or (b) said plurality of electrodes define a geometric volume, wherein said geometric volume is selected from the group consisting of: (i) one or more spheres; (ii) one or more oblate spheroids; (iii) one or more prolate spheroids; (iv) one or more ellipsoids; and (v) one or more scalene ellipsoids.

4. An Electron Transfer Dissociation fragmentation device as claimed in claim 1, wherein either:

(a) a geometric volume defined by the internal diameters of the apertures of said plurality of electrodes is selected from the group consisting of: (i)<1.0 $cm^3$; (ii) 1.0-2.0 $cm^3$; (iii) 2.0-3.0 $cm^3$; (iv) 3.0-4.0 $cm^3$; (v) 4.0-5.0 $cm^3$; (vi) 5.0-6.0 $cm^3$; (vii) 6.0-7.0 $cm^3$; (viii) 7.0-8.0 $cm^3$; (ix) 8.0-9.0 $cm^3$; (x) 9.0-10.0 $cm^3$; (xi) 10.0-11.0 $cm^3$; (xii) 11.0-12.0 $cm^3$; (xiii) 12.0-13.0 $cm^3$; (xiv) 13.0-14.0 $cm^3$; (xv) 14.0-15.0 $cm^3$; (xvi) 15.0-16.0 $cm^3$; (xvii) 16.0-17.0 $cm^3$; (xviii) 17.0-18.0 $cm^3$; (xix) 18.0-19.0 $cm^3$; (xx) 19.0-20.0 $cm^3$; (xxi) 20.0-25.0 $cm^3$; (xxii) 25.0-30.0 $cm^3$; (xxiii) 30.0-35.0 $cm^3$; (xxiv) 35.0-40.0 $cm^3$; (xxv) 40.0-45.0 $cm^3$; (xxvi) 45.0-50.0 $cm^3$; and (xxvii) >50.0 $cm^3$; or (b) an effective ion trapping volume or region, in use, for an ion having a mass to charge ratio of 100, 200, 300, 400, 500, 600, 700, 800, 900 or 1000 within said device is selected from the group consisting of: (i)<1.0 $cm^3$; (ii) 1.0-2.0 $cm^3$; (iii) 2.0-3.0 $cm^3$; (iv) 3.0-4.0 $cm^3$; (v) 4.0-5.0 $cm^3$; (vi) 5.0-6.0 $cm^3$; (vii) 6.0-7.0 $cm^3$; (viii) 7.0-8.0 $cm^3$; (ix) 8.0-9.0 $cm^3$; (x) 9.0-10.0 $cm^3$; (xi) 10.0-11.0 $cm^3$; (xii) 11.0-12.0 $cm^3$; (xiii) 12.0-13.0 $cm^3$; (xiv) 13.0-14.0 $cm^3$; (xv) 14.0-15.0 $cm^3$; (xvi) 15.0-16.0 $cm^3$; (xvii) 16.0-17.0 $cm^3$; (xviii) 17.0-18.0 $cm^3$; (xix) 18.0-19.0 $cm^3$; (xx) 19.0-20.0 $cm^3$; (xxi) 20.0-25.0 $cm^3$; (xxii) 25.0-30.0 $cm^3$; (xxiii) 30.0-35.0 $cm^3$; (xxiv) 35.0-40.0 $cm^3$; (xxv) 40.0-45.0 $cm^3$; (xxvi) 45.0-50.0 $cm^3$; and (xxvii) >50.0 $cm^3$.

5. An Electron Transfer Dissociation fragmentation device as claimed in claim 1, further comprising transient DC voltage means arranged and adapted to apply one or more transient DC voltages or one or more transient DC voltage waveforms to at least some of said plurality of electrodes in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of said Electron Transfer Dissociation fragmentation device in a mode of operation.

6. An Electron Transfer Dissociation fragmentation device as claimed in claim 1, wherein either:

(a) in a mode of operation ions are collisionally cooled or thermalised by collisions with a gas within said Electron Transfer Dissociation fragmentation device;

(b) said Electron Transfer Dissociation fragmentation device further comprises a cooling device for cooling said plurality of electrodes or a gas present within said device to a temperature selected from the group consisting of: (i) <20 K; (ii) 20-40 K; (iii) 40-60 K; (iv) 60-80 K; (v) 80-100 K; (vi) 100-120 K; (vii) 120-140 K; (viii) 140-160 K; (ix) 160-180 K; (x) 180-200 K; (xi) 200-220 K; (xii) 220-240 K; (xiii) 240-260 K; (xiv) 260-280 K; and (xv) 280-300K.

7. A mass spectrometer comprising an Electron Transfer Dissociation fragmentation device comprising a plurality of electrodes, wherein said device comprises at least five electrodes each having at least one aperture through which ions are transmitted in use; wherein the internal diameter of the apertures of the plurality of electrodes progressively increases and then progressively decreases one or more times along the longitudinal axis of said device.

8. A mass spectrometer as claimed in claim 7, further comprising a first mass filter arranged upstream of said Electron Transfer Dissociation fragmentation device wherein said first mass filter is selected from the group consisting of:

(i) a quadrupole rod set mass filter;

(ii) a Time of Flight mass filter; and (iii) a magnetic sector mass filter.

9. A mass spectrometer as claimed in claim 7, further comprising either:

(a) a first ion source arranged upstream or downstream of said Electron Transfer Dissociation fragmentation device, wherein said first ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source; and/or (b) a second ion source arranged upstream or downstream of said Electron Transfer Dissociation fragmentation device, wherein said second ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source; or (c) an ion source arranged upstream and/or downstream of said Electron Transfer Dissociation fragmentation device which is arranged, in use, to produce positively charged analyte ions; or (d) an ion source arranged upstream or downstream of said Electron Transfer Dissociation fragmentation device which is arranged, in use, to produce negatively charged reagent ions.

10. A method of fragmenting ions by Electron Transfer Dissociation, comprising:

providing a fragmentation device comprising a plurality of electrodes, wherein said device comprises at least five electrodes each having at least one aperture through which ions are transmitted; wherein the internal diameter of the apertures of said plurality of electrodes progressively increases and then progressively decreases one or more times along the longitudinal axis of said device; and fragmenting ions with reagent ions to form fragment ions with said device.

11. A method of mass spectrometry comprising:

providing an Electron Transfer Dissociation reaction or fragmentation device comprising a plurality of electrodes; wherein the internal diameter of the apertures of said plurality of electrodes progressively increases and then progressively decreases one or more times along the longitudinal axis of said device; and providing an axial or orthogonal acceleration Time of Flight mass analyser arranged to receive ions from said Electron Transfer Dissociation reaction or fragmentation device;

reacting or fragmenting positively charged analyte ions with negatively charged reagent ions within said Electron Transfer Dissociation reaction or fragmentation device to form a plurality of fragment or product ions, wherein said analyte ions or reagent ions or fragment or product ions are arranged to assume a mean kinetic energy selected from the group consisting of: (i) <5 meV; (ii) 5-10 meV; (iii) 10-15 meV; (iv) 15-20 meV; (v) 20-25 meV; (vi) 25-30 meV; (vii) 30-35 meV; (viii) 35-40 meV; (ix) 40-45 meV; (x) 45-50 meV; (xi) 50-55 meV; (xii) 55-60 meV; (xiii) 60-65 meV; (xiv) 65-70 meV; and (xv) >70 meV; and transmitting fragment or product ions to said Time of Flight mass analyser in order to be mass analysed.

12. A method of mass spectrometry comprising cooling analyte ions and/or reagent ions and/or fragment or product ions to a kinetic energy <40 meV, <45 meV, <50 meV, <55 meV or <60 meV within an Electron Transfer Dissociation device, a Proton Transfer reaction device or an ion-ion interaction device comprising a plurality of electrodes, wherein the internal diameter of the apertures of said plurality of electrodes progressively increases and then progressively decreases one or more times along the longitudinal axis of said device; and then transmitting fragment or product ions to a Time of Flight mass analyser.

13. An Electron Transfer Dissociation device, a Proton Transfer reaction device or an ion-ion interaction device comprising a plurality of electrodes each having an aperture through which ions are transmitted in use; wherein the internal diameter of the apertures of said plurality of electrodes progressively increases and then progressively decreases one or more times along the longitudinal axis of said device; and wherein in a mode of operation ions are confined radially or axially within said device and a substantially electric field free region is formed within at least 5%, 10%, 15%, 20%, 25%, 30%, 35%, 40%, 45%, 50%, 55%, 60%, 65%, 70%, 75%, 80%, 85% or 90% of the volume defined by the internal diameters of said plurality of electrodes.

14. A method of Electron Transfer Dissociation, Proton Transfer reaction or ion-ion interaction comprising:

providing a plurality of electrodes each having an aperture through which ions are transmitted; wherein the internal diameter of the apertures of said plurality of electrodes progressively increases and then progressively decreases one or more times along the longitudinal axis of said device;

confining ions radially or axially within said device; and forming a substantially electric field free region within at least 5%, 10%, 15%, 20%, 25%, 30%, 35%, 40%, 45%, 50%, 55%, 60%, 65%, 70%, 75%, 80%, 85% or 90% of the volume defined by the internal diameters of said plurality of electrodes.

* * * * *